US006942482B2

(12) United States Patent
Honda et al.

(10) Patent No.: US 6,942,482 B2
(45) Date of Patent: Sep. 13, 2005

(54) COMBUSTION CONTROL DEVICE

(75) Inventors: Katsutoshi Honda, Aichi-ken (JP); Koji Nozawa, Ishikawa-ken (JP)

(73) Assignees: Rinnai Corporation, Aichi-ken (JP); RB Controls Co., Ltd., Ishikawa-ken (JP)

( * ) Notice: Subject to any disclaimer, the term of this patent is extended or adjusted under 35 U.S.C. 154(b) by 0 days.

(21) Appl. No.: 10/651,213

(22) Filed: Aug. 29, 2003

(65) Prior Publication Data

US 2004/0048212 A1 Mar. 11, 2004

(30) Foreign Application Priority Data

Sep. 2, 2002 (JP) ..... 2002/256544

(51) Int. Cl.[7] ..... F23N 5/00

(52) U.S. Cl. ..... 431/24; 431/67; 431/72; 431/73

(58) Field of Search ..... 431/24, 67, 72, 431/73, 74, 86

(56) References Cited

U.S. PATENT DOCUMENTS

| | | | | | |
|---|---|---|---|---|---|
| 4,190,414 | A | * | 2/1980 | Elmy | 432/46 |
| 4,375,950 | A | * | 3/1983 | Durley, III | 431/12 |
| 5,094,259 | A | * | 3/1992 | Hsu | 137/66 |
| 5,722,823 | A | * | 3/1998 | Hodgkiss | 431/43 |
| 6,666,676 | B2 | * | 12/2003 | Rodriguez-Rodriguez et al. | 431/67 |

* cited by examiner

*Primary Examiner*—Alfred Basichas
(74) *Attorney, Agent, or Firm*—Arent Fox PLLC

(57) ABSTRACT

A safety circuit 31, which compulsorily closes an on-off valve for supplying a gas to a burner when a microcomputer for performing a combustion control is in an abnormal condition, does not operate unless abnormality occurs to the microcomputer 1, and therefore even when the safety circuit 31 is out of order, an ignition operation is performed as it is. A transistor 4 is not turned off until a fixed time elapses from a start of an ignition sequence in the safety circuit 31, but the fixed time is shortened by a timer acceleration circuit 32, and if the transistor 4 is turned off by a transistor 2 being turned on, the safety circuit 31 is determined as normal, so that the normal ignition sequence is executed thereafter.

12 Claims, 2 Drawing Sheets

COMBUSTION CONTROL DEVICE

BACKGROUND OF THE INVENTION

1. Field of the Invention

The present invention relates to combustion control devices for performing opening and closing controls of gas feed passages to gas burners to control combustion, and particularly relates to combustion control devices which perform self-checking of safety circuits of gas burners with use of microcomputers prior to start of combustion operations of the gas burners contained in gas water heaters and the other gas appliances.

2. Description of the Related Art

As is known from, for example, Japanese Patent Laid-open No. 2000-161661, a gas appliance is provided with an on-off valve at a gas feed passage for supplying a gas to a gas burner to perform a combustion control. Recently, a gas appliance, which uses an electromagnetic type on-off valve as this on-off valve and performs an on-off control of the electromagnetic type on-off valve by a microcomputer, comes on the market. In the gas appliance of a microcomputer control, the electromagnetic type on-off valve is opened and an ignition plug is operated when a gas burner is ignited by an ignition plug or the like. A detection signal from a flame, detection circuit using a thermocouple or a flame rod which is placed in the vicinity of a burner port of the gas burner is detected with the microcomputer, and when it is determined that the ignition operation normally functions, the electromagnetic type on-off valve is controlled to be opened continuously.

When ignition is not confirmed even a predetermined time elapses after the electromagnetic type on-off valve is opened by an ignition start command from the microcomputer and the ignition plug is operated, the microcomputer determines that the ignition operation fails, and controls the electromagnetic type on-off valve to be closed.

However, if the microcomputer does not operate normally for some reason, there arises the possibility that the electromagnetic type on-off valve is not closed even when the ignition operation ends in failure. Thus, a safety circuit, which is safety means, is constituted such that it is provided separately from the microcomputer, and even if the microcomputer does not operate normally, the electromagnetic type on-off valve is compulsively closed unless the gas burner is ignited at the point of time at which the predetermined time elapses from the start of the ignition operation.

This safety circuit generates a misfire signal by combining the flame detection signal from the flame detection circuit and a detection signal of an on-off state of the electromagnetic type on-off valve provided at the gas feed passage. A switch such as a transistor is provided at a solenoid coil of the electromagnetic type on-off valve or a solenoid coil of a relay for energizing a solenoid, and when the misfire signal is outputted from the safety circuit, the switch is turned off to cut off passage of current to the solenoid coil of the electromagnetic type on-off valve compulsorily. The electromagnetic on-off valve is constituted so that the valve body is shifted to a closed valve state by a biasing force of a spring contained therein, when the passage of the current to this solenoid coil is cut off.

If the gas burner is not ignited at a point of time at which a predetermined time elapses after the microcomputer starts the ignition operation, the microcomputer compulsorily closes the on-off valve, and the predetermined time elapsing until the above-described safety circuit operates is set to be a longer time than the predetermined time provided for the microcomputer to confirm the ignited state.

The above-described safety circuit is provided for the case in which the microcomputer fails, but in the state in which the microcomputer normally operates, the safety circuit does not operate. Even if the safety circuit fails, the gas burner is ignited without any problems while the microcomputer is normally operating. Consequently, if the failure of the safety circuit is overlooked when the safety circuit fails, the safety circuit does not operate if the microcomputer fails, and there arises the problem that nothing is changed from the state in which the safety circuit is not provided.

Consequently, the present invention is made in view of the above-described problem, and has its object to provide a combustion control device capable of detecting a failure of a safety circuit.

SUMMARY OF THE INVENTION

In order to solve the above-described problem, a combustion control device according to the present invention is, in a combustion control device comprising clock means for clocking a predetermined time from a point of time at which a microcomputer starts an ignition sequence of opening an on-off valve for supplying a gas to a gas burner and operating an ignition plug, and provided with safety means for detecting an ignited state of the gas burner at a point of time at which the clock means clocks the predetermined time and compulsorily closing the above-described on-off valve when the gas burner is not in the ignited state, separately from the above-described microcomputer, characterized in that the microcomputer detects an open and closed state of the on-off valve as a result of compulsorily operating the above-described safety means to perform an operation check of the safety means, before operating the above-described ignition sequence.

Normally, the safety means does not operate unless abnormality occurs to the microcomputer. Thus, the safety means is compulsorily operated prior to the ignition sequence, and if the safety means operates normally, the sequence is shifted to the normal ignition sequence.

The safety means is provided with clock means, and a predetermined time is required until it operates, but if the predetermined time is required to confirm the operation of the safety means, shift to the ignition sequence takes place too late, which not only impairs usability as a gas appliance but also has an adverse effect on the normal ignition sequence in some cases. Consequently, when the above-described safety means is compulsorily operated, the time clocked by the above-described clock means is shortened, and thereby such a problem can be solved.

DETAILED DESCRIPTION OF THE PREFERRED EMBODIMENT(S)

Figure 1:
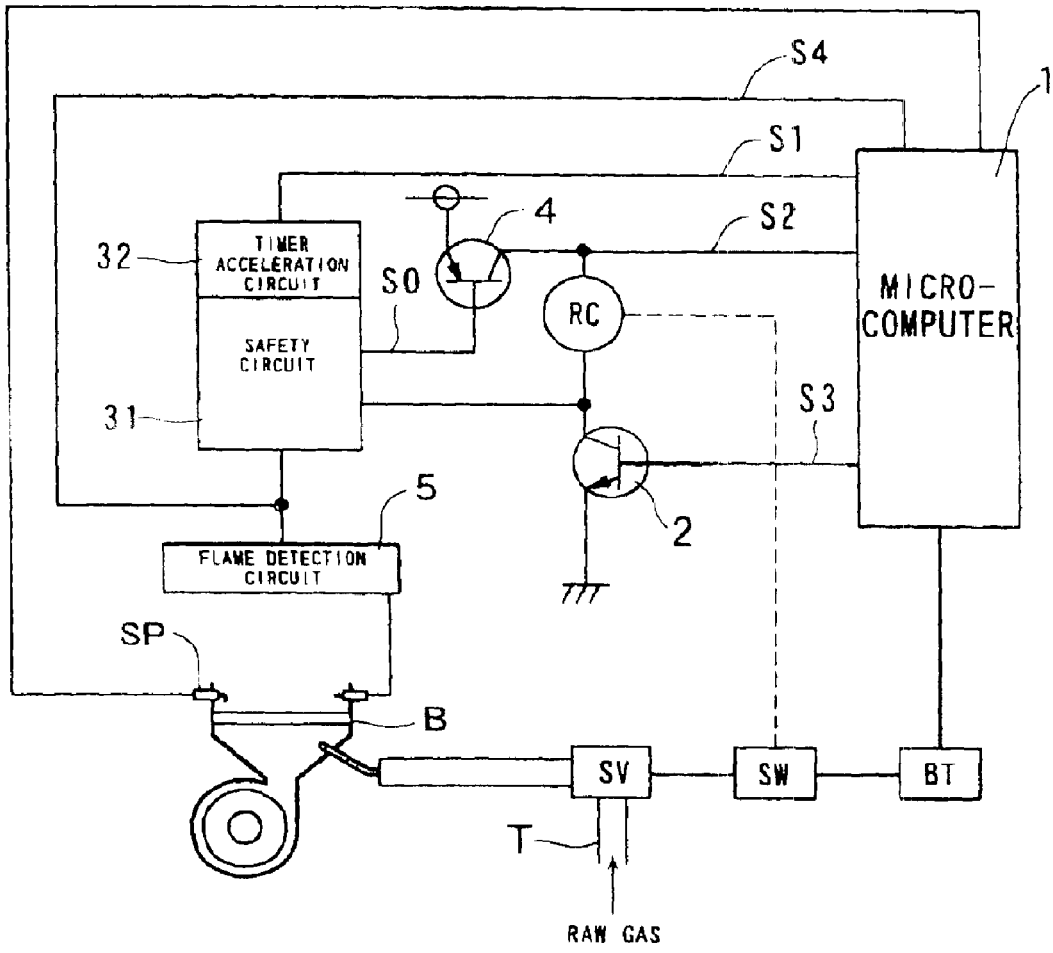
FIG. 1 is a block diagram showing a constitution of a combustion control device according to an embodiment.

In FIG. 1, reference numeral B denotes a gas burner, and piping is arranged so that supply of a fuel gas is received via a gas feed passage T. The gas feed passage T is provided with an on-off valve SV which is opened and closed by electromagnet. Reference numeral BT is a driving power supply for the on-off valve SV, and wiring is provided so that when an electric current flows into a relay coil RC, a relay switch SW is turned on, and when electric power is supplied to the on-off valve SV from the driving power supply BT, the on-off valve SV is opened. On the other hand, when the electric current does not flow into the relay coil RC, the relay switch SW is turned off, and the electromagnetic force which keeps the on-off valve SV in the open state does not exist, and therefore the on-off valve SV is constituted so as to be closed by a biasing force of a spring contained in the on-off valve SV.

The relay coil RC is connected to power supply voltage via two switch elements. A first switch element is a transistor 2 which is turned on and off according to a signal from a microcomputer 1. This transistor 2 is connected to between a ground potential and the relay coil RC in series, and when it is turned on in accordance with a switch-on command S3 of the microcomputer 1, one end of the relay coil RC is at the ground potential.

A second switch element is connected to a safety circuit 31, and is a transistor 4 which is turned on and off by this safety circuit 31. The transistor 4 is connected to between the power supply voltage and the relay coil RC in series. The transistor 4 has an emitter connected to the power supply voltage and a collector connected to the other end of the relay coil RC. The transistor 4 is constituted to be always on by a signal from the safety circuit 31, and the transistor 4 is constituted to be turned off when an Hi signal is supplied as a misfire signal S0 to a base of the transistor 4 from the safety circuit 31, so that the electric current to the relay coil RC is shut off by cutting off the relay coil RC from the power supply voltage.

A thermocouple TC, which is placed in close vicinity to, for example, the gas burner B, is connected to the flame detection circuit 5 to detect an ignited state of the gas burner B. When a spark discharge is caused between a sparker SP and the burner in a state in which a fuel gas is issued from the gas burner B, the gas burner B is brought into the ignited state. Like this, when the gas burner B is ignited, the thermocouple TC is heated, and a thermo-electromotive force is outputted from the thermocouple TC. The flame detection circuit 5 inputs the thermo-electromotive force therein, determines the ignited state of the burner B, and transmits a flame detection signal indicating the ignited state to the safety circuit 31.

Meanwhile, when the transistor 2 is turned on, the ground potential is inputted into the safety circuit 31 in accordance with the switch-on command S3, and it is determined that the electromagnetic valve SV is brought into the open state.

The safety circuit 31 is constituted to contain a timer circuit TM that is clock means, which clocks a predetermined time from a point of time at which the electromagnetic valve SV is brought into the open state, and if a signal indicating that the burner is in the ignited state is not inputted into the safety circuit 31 from the flame detection circuit 5 at a point of time at which the predetermined time elapses, namely, at a point of time at which the clocking time becomes zero, the safety circuit 31 determines that the ignition fails, then outputs the misfire signal S0 to the transistor 4, and turns off the transistor 4. When the transistor 4 is turned off as this, the on-off valve SV is compulsorily brought into a closed state.

A timer acceleration circuit 32 accelerates clocking speed so that clocking time of an inner timer of the safety circuit 31 immediately becomes zero, when a self-check command S1 is outputted from the microcomputer 1.

Meanwhile, the microcomputer 1 monitors that an ignition signal S4 is inputted from the flame detection circuit 5 when it starts an ordinary ignition sequence which it starts by an ignition operation being performed. If the ignition signal S4 is not inputted therein after a fixed time elapses from the start of the ignition sequence, the microcomputer 1 determines it as an ignition operation failure, and temporarily closes the on-off valve SV by turning off the transistor 2. Thereafter, it executes the ignition sequence from the start again to perform ignition to the burner B. When the ignition signal S4 is not inputted therein after the fixed time elapses from the start of the second ignition sequence, it closes the on-off valve SV again, and thereafter, it shifts to a predetermined error sequence.

Incidentally, the above-described fixed time programmed in the microcomputer 1 is set to be shorter than the predetermined time which the timer circuit TM contained in the safety circuit 31 clocks. Accordingly, when ignition to the burner 1 fails, the safety circuit 31 operates and before the transistor 4 is turned off, the microcomputer 1 turns off the transistor 2 to close the on-off valve SV.

Incidentally, in order that the safety circuit 31 operates to turn off the transistor 4 and closes the on-off valve SV reliably when an abnormal condition occurs, the microcomputer 1 checks whether the misfire signal S0 is outputted normally from the safety circuit 31 before it executes the ignition sequence of the gas burner B. This check sequence is a sequence to determine whether the safety circuit 31 normally operates with the microcomputer 1 as an initial check, and stop a combustion operation if there is any abnormality, prior to the ignition sequence for the combustion operation of the gas appliance.

Figure 2:
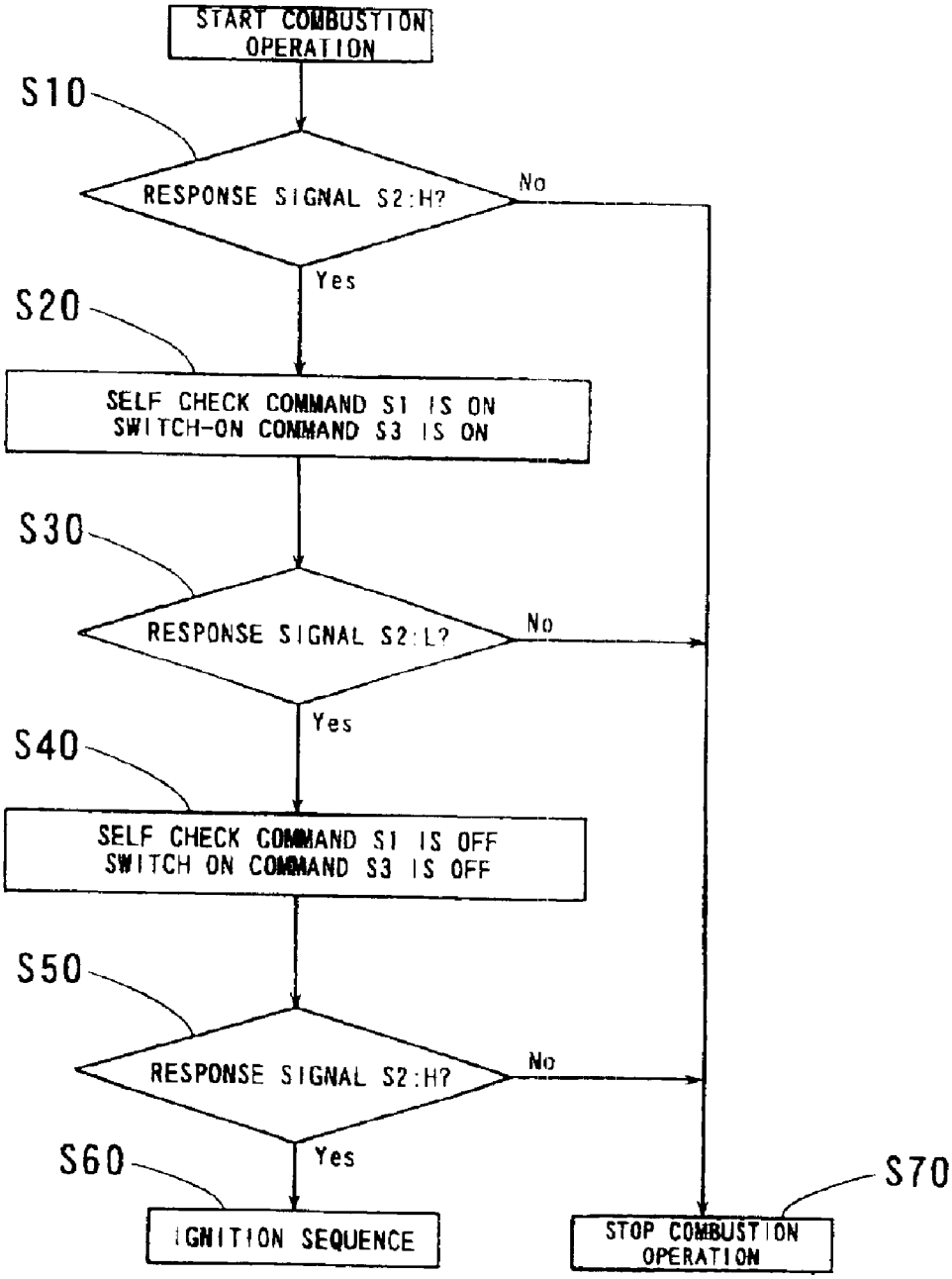
FIG. 2 is a flow chart showing steps of a check sequence.

Next, this check sequence will be explained in concrete. FIG. 2 is a flow chart showing steps of the check sequence up to the shift to the ignition sequence after the combustion operation starting command is issued.

In step 10, a signal level of a response signal S2 at a collector potential of the transistor 4 is determined. If this response signal S2 is at a high level (H), the transistor 4 is in the on state. Namely, the combustion control device is in an initial state, and at this point of time, the safety circuit 31 is in a state in which it does not perform an operation corresponding to an abnormal condition, namely, the transistor 4 is in the on state, and the relay coil RC is in a state in which power supply voltage is applied to the relay coil RC. In this state, the response signal S2 to the microcomputer 1 is in a high level (H) state, and it is confirmed that the safety circuit 31 is normally operating.

If the response signal S2 to the microcomputer 1 is not at a high level, the transistor 4 is not in the on state, and therefore the safety circuit 31 is determined as abnormal, thus proceeding to a combustion operation stopping sequence (step 70) which will be described later.

In the next step 20, the self-check function which the microcomputer 1 has is turned on to output the self-check command S1 to the timer acceleration circuit 32, and the switch-on command S3 is outputted to turn on the transistor 2. In the timer acceleration circuit 32, reference time set at an inside of the safety circuit 31 can be reset to be short by changing a resistor of, for example, a CR time constant circuit to the one with a small value, by the self-check command S1.

If the reference time is set to be short as above, the reference time elapses rapidly, and thereafter the safety circuit 31 immediately performs ignition determination. At this point of time, the burner B is not ignited, and therefore a signal indicating a state in which the burner B is not ignited is outputted to the safety circuit 31 from the flame detection circuit 5. Since the transistor 2 is on, the potential of the collector of the transistor 2 is at the ground potential, and the safety circuit 31 determines that the on-off valve SV is opened. The reference time is actually shortened, and therefore the on-off valve SV is not necessarily opened at this point of time, but the safety circuit 31 determines it as an ignition failure and outputs the misfire signal S0 to the transistor 4.

In step 30, the signal level of the response signal S2 of the safety circuit 31 is determined as in step 10. Here, only an electromagnetic valve-on signal is inputted into the safety circuit 31 in a state in which the flame detection signal is not inputted into the safety circuit 31, and the misfire signal S0 is immediately outputted to the transistor 4, whereby the transistor 4 is turned off by the misfire signal S0, and the signal level of the response signal S2 to the microcomputer 1 is changed to the low level (L) state. When the signal level of the response signal S2 is changed to the L state like this, it is confirmed that the safety circuit 31 normally operates, and a command is given to proceed to the next step 40.

However, if the response signal S2 to the microcomputer 1 remains in the H state, it is determined that the safety circuit 31 does not operate normally, and a command is given to proceed to a combustion operation stopping sequence (step 70) which will be described later.

Since it is already determined that the safety circuit 31 operates normally in step 40 and step 50, the self check function is turned off with the microcomputer 1, then a command is given to proceed to step 50 with the switch-on command S3 being turned off, and after it is confirmed that the state is returned to the initial state as in step 10, a command is given to shift to an ignition sequence (S60).

Since the safety circuit 31 is normal, the response signal S2 to the microcomputer 1 is supposed to be in the H state, but if it remains in the L state, the safety circuit 31 is determined as abnormal, and a command is given to proceed to the combustion operation stopping sequence (step 70) which will be described later.

Step 70 is the combustion operation stopping sequence, which indicates a predetermined error message on a display or the like, and makes irregular stop of the gas appliance.

What is claimed is:

1. A combustion control device comprising:

clock means for clocking a predetermined time from a point of time at which a microcomputer starts an ignition sequence of opening an on-off valve for supplying a gas to a gas burner and operating an ignition plug;

safety means for detecting an ignited state of the gas burner at a point of time at which said clock means clocks the predetermined time and compulsorily closing the on-off valve when the gas burner is not in the ignited state, separately from the microcomputer; and an on-off sensor for detecting an opening and closing state of the on-off valve, wherein the microcomputer performs an operation check of the safety means by compulsorily operating the safety means and receiving an opening and closing state of the on-off valve, before operating the ignition sequence.

2. The combustion control device according to claim 1, wherein when the safety means is compulsorily operated, the time clocked by said clock means is shortened.

3. The combustion control device according to claim 2, wherein said clock means is constituted to contain a resistor so that the clocking time becomes shorter as a resistance value of this resistor becomes smaller, and when the safety means is compulsorily operated, this resistor is short-circuited, or this resistor is changed to a resistor with a smaller resistance value, whereby the clocked time is shortened.

4. The combustion control device according to claim 1, wherein the on-off valve is opened and closed by a relay, and a transistor turned on and off by the microcomputer and a transistor turned on and off by the safety means are connected in series to a relay coil of this relay.

5. The combustion control device according to claim 2, wherein the on-off valve is opened and closed by a relay, and a transistor turned on and off by the microcomputer and a transistor turned on and off by the safety means are connected in series to a relay coil of this relay.

6. The combustion control device according to claim 3, wherein the on-off valve is opened and closed by a relay, and a transistor turned on and off by the microcomputer and a transistor turned on and off by the safety means are connected in series to a relay coil of this relay.

7. The combustion control device according to claim 1, further comprising:

a thermocouple for detecting the ignited state of the gas burner, which is placed in a vicinity of the gas burner.

8. The combustion control device according to claim 2, further comprising:

a thermocouple for detecting the ignited state of the gas burner, which is placed in a vicinity of the gas burner.

9. The combustion control device according to claim 3, further comprising:

a thermocouple for detecting the ignited state of the gas burner, which is placed in a vicinity of the gas burner.

10. The combustion control device according to claim 4, further comprising:

a thermocouple for detecting the ignited state of the gas burner, which is placed in a vicinity of the gas burner.

11. The combustion control device according to claim 5, further comprising:

a thermocouple for detecting the ignited state of the gas burner, which is placed in a vicinity of the gas burner.

12. The combustion control device according to claim 6, further comprising:

a thermocouple for detecting the ignited state of the gas burner, which is placed in a vicinity of the gas burner.

* * * * *